US010695657B2

(12) United States Patent
Charkales

(10) Patent No.: US 10,695,657 B2
(45) **Date of Patent: *Jun. 30, 2020**

(54) LOCOMOTION APPARATUS HAVING A SNOW SKI AND SKATE BOARD PLATFORM COMBINATION WITH BRAKE

(71) Applicant: George Andrew Charkales, Stamford, CT (US)

(72) Inventor: George Andrew Charkales, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/105,460

(22) Filed: Aug. 20, 2018

(65) Prior Publication Data

US 2018/0353841 A1 Dec. 13, 2018

Related U.S. Application Data

(63) Continuation of application No. 15/424,555, filed on Feb. 3, 2017, now Pat. No. 10,052,549.

(60) Provisional application No. 62/292,646, filed on Feb. 8, 2016.

(51) Int. Cl.

| | |
|---|---|
| ***A63C 17/18*** | (2006.01) |
| ***A63C 5/03*** | (2006.01) |
| ***A63C 17/01*** | (2006.01) |

(52) U.S. Cl.

CPC ..... *A63C 17/18* (2013.01); *A63C 5/033* (2013.01); *A63C 17/017* (2013.01); *A63C 2203/065* (2013.01); *A63C 2203/46* (2013.01)

(58) Field of Classification Search

CPC ..... A63C 17/18; A63C 17/017; A63C 5/033; A63C 2203/065; A63C 2203/46

See application file for complete search history.

(56) References Cited

U.S. PATENT DOCUMENTS

| | | | | | |
|---|---|---|---|---|---|
| 3,583,722 | A * | 6/1971 | Jacobson | A63C 17/018 | 280/16 |
| 3,802,714 | A * | 4/1974 | Freegard | A63C 5/033 | 280/607 |
| 3,929,344 | A * | 12/1975 | Ott | A63C 5/033 | 280/607 |
| 4,114,913 | A * | 9/1978 | Newell | A63C 1/00 | 280/14.21 |
| 4,116,455 | A * | 9/1978 | Dotson | A63C 5/031 | 280/13 |
| D250,055 | S * | 10/1978 | Dotson | D12/11 | |
| 4,138,128 | A * | 2/1979 | Criss | A63C 5/031 | 280/14.21 |

(Continued)

OTHER PUBLICATIONS

Snowskate, Wikipedia, https://en.wikipedia.org/wiki/Snowskate.

(Continued)

*Primary Examiner* — Jacob B Meyer

(74) *Attorney, Agent, or Firm* — Robert J. Hess; Hess Patent Law Firm

(57) ABSTRACT

A locomotion apparatus that has a base that secures a skateboard platform to a snow ski as a combination. The base is secured into position by bindings of a ski. A brake mechanism is provided that has a brake seat, a lever arm and a spring arm that cooperate with each other to enable the brake mechanism to move between a deployed brake position, at which the combination brakes to prevent its locomotion, and a non-deployed brake position, at which the locomotion is enabled.

17 Claims, 17 Drawing Sheets

(56) References Cited

U.S. PATENT DOCUMENTS 4,161,323 A * 7/1979 Wetteland ..... A63C 5/031 280/13
4,161,324 A * 7/1979 Colvin ..... B62B 13/04 280/14.25
4,175,759 A * 11/1979 Strunk ..... B62B 13/10 280/14.21
4,194,753 A * 3/1980 Schrishuhn, Jr. ..... A63C 17/26 280/13
4,221,394 A * 9/1980 Campbell ..... A63C 5/031 280/14.25
4,225,145 A * 9/1980 Carr ..... A63C 5/031 280/14.21
4,678,200 A * 7/1987 Powell ..... A63C 5/033 280/607
4,784,233 A * 11/1988 Favors ..... A63C 5/031 280/14.25
5,022,668 A * 6/1991 Kenny ..... A63C 5/03 280/11.28
5,161,810 A * 11/1992 DeCesare ..... A63C 1/00 280/14.21
5,249,816 A * 10/1993 Southworth ..... A63C 5/031 280/14.25
5,411,282 A * 5/1995 Shannon ..... A63C 5/031 280/14.24
5,558,354 A * 9/1996 Lion ..... A63C 5/033 280/607
6,113,113 A * 9/2000 Longoni ..... A63C 5/03 280/14.22
6,311,990 B1 * 11/2001 Landry ..... A63C 1/36 280/14.26
6,341,786 B1 * 1/2002 Kermis ..... A63C 5/031 280/14.22
6,481,725 B2 * 11/2002 Chou ..... A63C 5/03 280/14.21
6,619,674 B2 * 9/2003 Baldwin ..... A63C 1/00 280/11.18
6,648,348 B2 * 11/2003 Link ..... A63C 5/031 280/14.25
6,682,083 B2 * 1/2004 Melcher ..... A63C 5/033 280/14.26
6,702,315 B2 * 3/2004 Barbieri ..... A63C 5/03 188/128
6,773,021 B2 * 8/2004 Breuer ..... A63C 5/03 280/14.21
6,789,806 B2 * 9/2004 Santa Cruz ..... A63C 5/03 280/14.21
6,857,641 B2 * 2/2005 Bobrowicz ..... A63C 5/03 280/14.21
6,857,653 B2 * 2/2005 Wilson ..... A63C 5/0485 280/602
6,866,273 B2 * 3/2005 Barbieri ..... A63C 5/03 280/14.21
6,910,695 B2 * 6/2005 Ellington ..... A63C 5/033 280/14.22
7,040,634 B1 * 5/2006 Elkins, Jr. ..... A63C 5/031 280/14.25
7,281,729 B1 * 10/2007 Wilson ..... A63C 5/0485 280/602
7,318,591 B2 * 1/2008 Landry ..... A63C 1/00 280/14.21
7,425,017 B2 * 9/2008 Mash ..... A63C 5/075 280/14.22
7,581,735 B2 * 9/2009 Birdsell ..... A63C 5/031 280/14.21
7,699,323 B2 * 4/2010 Taylor ..... A63C 1/36 280/14.21
7,708,302 B2 * 5/2010 Wilson ..... A63C 5/03 280/11.14
8,246,070 B2 * 8/2012 Lin ..... A63C 5/03 280/11.14
8,632,079 B2 * 1/2014 Ryan ..... A63C 5/03 280/14.21
9,174,663 B2 * 11/2015 Reinig ..... B62B 13/12
9,717,976 B2 * 8/2017 Elphick ..... A63C 5/031
9,908,029 B2 * 3/2018 Linzmeier ..... A63C 5/075
2002/0008360 A1 * 1/2002 Ellington ..... A63C 5/033 280/14.21
2002/0043774 A1 * 4/2002 Chou ..... A63C 5/03 280/7.12
2002/0043775 A1 * 4/2002 Baldwin ..... A63C 1/00 280/14.21
2002/0050693 A1 * 5/2002 Link ..... A63C 5/031 280/14.25
2002/0070515 A1 * 6/2002 Barbieri ..... A63C 5/03 280/14.21
2002/0158430 A1 * 10/2002 Farcot ..... A63C 5/03 280/14.21
2002/0185828 A1 * 12/2002 Melcher ..... A63C 5/033 280/14.26
2002/0190501 A1 * 12/2002 Barbieri ..... A63C 5/03 280/604
2003/0085537 A1 * 5/2003 Breuer ..... A63C 5/03 280/14.21
2003/0160404 A1 * 8/2003 Bobrowicz ..... A63C 5/03 280/14.21
2003/0193168 A1 * 10/2003 Chou ..... A63C 5/02 280/607
2004/0084879 A1 * 5/2004 Wilson ..... A63C 5/0485 280/608
2004/0145152 A1 * 7/2004 Santa Cruz ..... A63C 5/03 280/602
2004/0232657 A1 * 11/2004 Lee ..... A63C 5/0405 280/618
2005/0012282 A1 * 1/2005 Woodruff ..... A63C 5/031 280/7.14
2005/0206109 A1 * 9/2005 Mash ..... A63C 5/075 280/87.042
2005/0212226 A1 * 9/2005 Landry ..... A63C 1/00 280/7.14
2006/0091645 A1 * 5/2006 Cobb ..... A63C 5/0405 280/609
2006/0226613 A1 * 10/2006 Wilson ..... A63C 5/03 280/14.22
2007/0120335 A1 * 5/2007 Birdsell ..... A63C 5/031 280/14.21
2008/0048415 A1 * 2/2008 Mann ..... A63C 5/02 280/601
2008/0246255 A1 * 10/2008 Hallsten ..... A63C 5/031 280/606
2009/0079149 A1 * 3/2009 Taylor ..... A63C 1/36 280/14.26
2009/0179391 A1 * 7/2009 Ota ..... A63C 5/03 280/14.22
2009/0206564 A1 * 8/2009 Lin ..... A63C 5/03 280/14.22
2010/0194076 A1 * 8/2010 Wilson ..... A63C 5/03 280/609
2010/0304941 A1 * 12/2010 Ota ..... A63C 5/03 482/146
2011/0089659 A1 * 4/2011 Hunt ..... A63C 17/0093 280/124.121
2012/0061928 A1 * 3/2012 Ryan ..... A63C 5/03 280/14.21
2014/0265178 A1 * 9/2014 Reinig ..... B62B 13/12 280/14.1
2016/0184688 A1 * 6/2016 Elphick ..... A63C 5/031 280/14.25
2017/0225062 A1 * 8/2017 Charkales ..... A63C 17/017
2017/0246526 A1 * 8/2017 Linzmeier ..... A63C 5/075

OTHER PUBLICATIONS

SKIboarding, Wikipedia, https://en.wikipedia.org/wiki/Skiboarding.

(56) References Cited

OTHER PUBLICATIONS

These non patent literature documents are with the application file for U.S. Appl. No. 15/424,555.

* cited by examiner

LOCOMOTION APPARATUS HAVING A SNOW SKI AND SKATE BOARD PLATFORM COMBINATION WITH BRAKE

CROSS-REFERENCE TO COPENDING PATENT APPLICATIONS

The present application is a continuation of U.S. utility patent application Ser. No. 15/424,555 filed Feb. 3, 2017 and accorded the benefit of invention priority from U.S. provisional patent application Ser. No. 62/292,646 filed Feb. 8, 2016.

BACKGROUND OF THE INVENTION

1. Field of the Invention

This invention relates generally to an apparatus that is used as a skateboard and, more particularly, to a snow ski device that operates like a skateboard on snow surfaces and which is equipped with a brake mechanism.

2. Description of the Related Art

As mentioned in U.S. Pat. No. 4,116,455:

Skateboards are generally used on smooth, flat surfaces so as to allow for better riding by easy acceptability of the wheels that are part of the device. However, at this time the skateboard is restricted in its use—not only to the type of surface of the ground area but also by weather conditions. That is, during the winter months, in areas that have snow conditions the ground surfaces become covered and a skateboard cannot be operated.

As mentioned in U.S. Pat. No. 7,581,735:

In the area of skateboarding, skateboarders have traditionally had to turn to snowboards to have similar recreation in the snowy weather. Snowboarding, however, varies in many significant ways from skateboarding. The most obvious difference is the fact that a snowboarder's feet are bound and attached through boots to the snowboard, whereas, on a skateboard, the rider's feet are merely placed on top of the deck of the skateboard and are easily freed from the board to perform tricks and to discontinue the use of the board. Another significant difference is the feel and handling of the snowboard compared to a skateboard due to the fact that the skateboard has wheels and a truck between the deck and the ground that allows for steering and control while a snowboard's deck comes in direct contact with the ground. The locked-in feet and lack of suspension/steering ability make snowboarding a related, but different skill than skateboarding. Another feature of snowboarding and skiing is that both are edging devices.

A bideck snowskate has a top skateboard deck, which the rider stands on, and a lower ski deck, which is in contact with the snow. Bidecks come in single blade varieties and multiple blade varieties. Different bidecks are tailored to a different style of riding. Longer bidecks are favored for mountain snowskating, and shorter bidecks are favored for tricks and stunts.

What is needed is a way to slide across snow on a snow ski while standing upon a skateboard platform (or deck) so as to retain the same freedom of feet movement that the user experiences when skateboarding on pavement, yet retaining the same ski shoe binding settings that the user needs for skiing with the snow skis separate from the skateboard platform.

SUMMARY OF THE INVENTION

One aspect of the invention is to provide a ski board that is adjustable to fit any conventional ski binding without having to alter the ski binding settings. An adjustment screw is provided to allow the user to adjust the base of the ski board to fit in the existing ski binding.

Another aspect is to provide for a stabilizer, which is located in the front of the ski board. The stabilizer is adjustable in that it screws down to stabilize the front of the ski board so that when the rider applies pressure or weight at the front of the ski board, the stabilizer will not allow the ski bindings to eject the ski board even though the ski binds are designed to eject the ski boot when a ski applies too much weight or presser to the front of the binding. The ski board stabilizer also adjusts forward and back to accommodate larger and smaller bindings.

An additional aspect is to provide a tether system that will keep the ski board from sliding away on its own down a hill when the rider comes off the ski board.

A further aspect is to equip the ski board with a brake mechanism. This brake mechanism engages while the rider is not applying pressure or weight to the front of the ski board. When the rider is not standing on the ski board, the brake mechanism engages and holds the ski board in place. This will also engage if the rider comes off the ski board. The ski boarder could also gradually lift their front leg (decreasing downward pressure) as they ride to engage the ski board break.

BRIEF DESCRIPTION OF THE DRAWINGS

For a better understanding of the present invention, reference is made to the following description and accompanying drawings, while the scope of the invention is set forth in the appended claims.

DESCRIPTION OF THE PREFERRED EMBODIMENT

Figure 1:
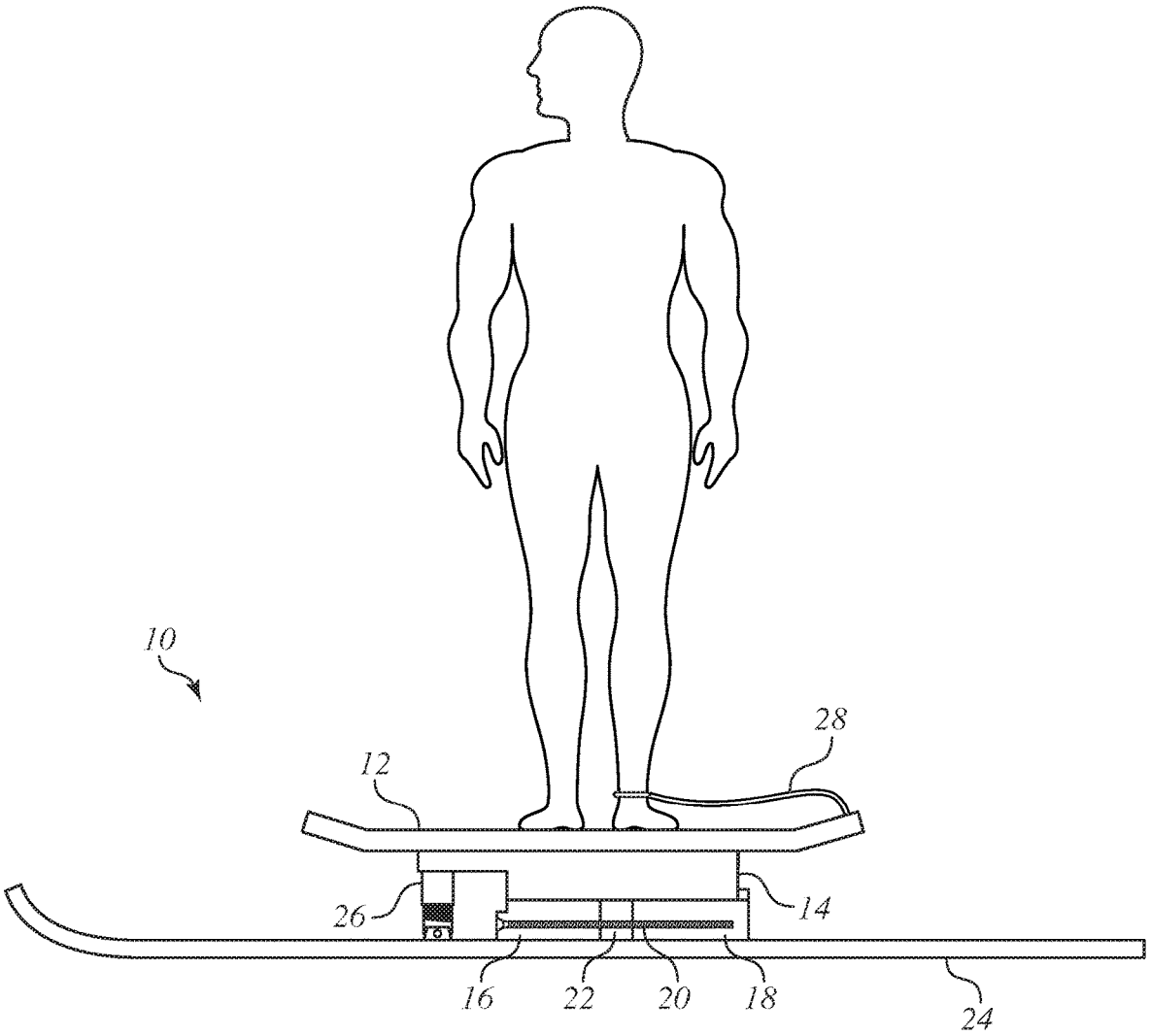
FIG. 1 is a side view of an assembled ski board unit in accordance with the invention that is shown tethered to a person's leg, but without the snow ski bindings shown.
Figure 2:
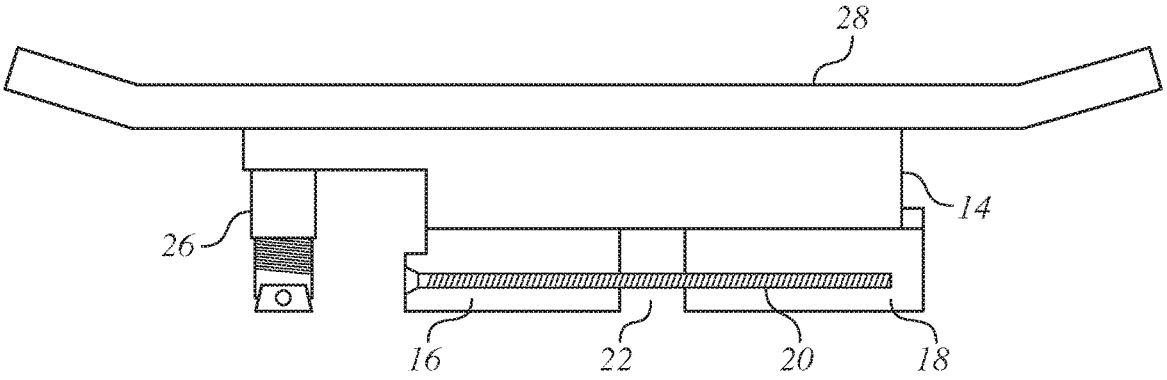
FIG. 2 is a side view of assembled ski board unit of FIG. 1, but without the tether and without the snow ski.
Figure 7:
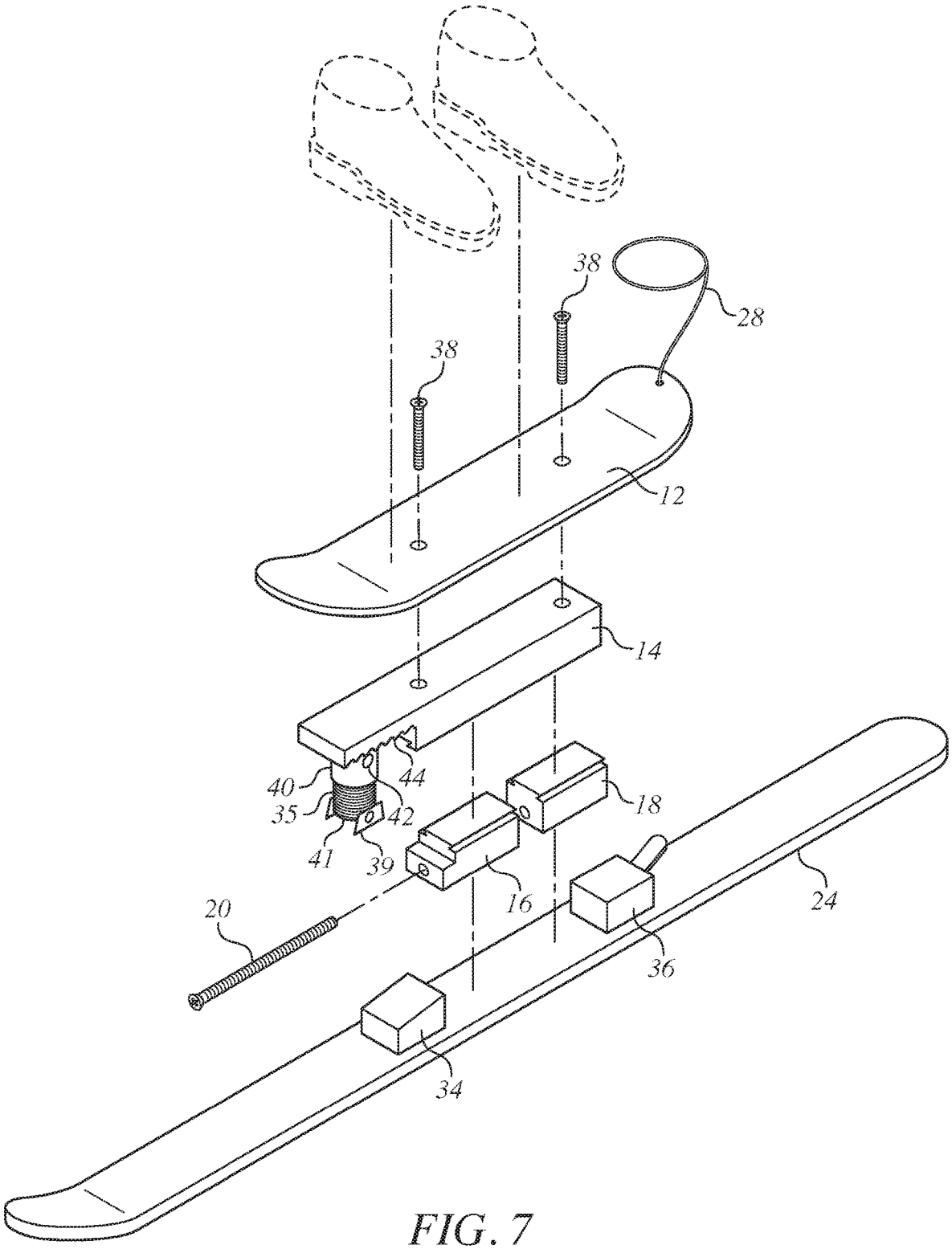
FIG. 7 is an exploded view of the ski board unit of FIG. 1.

Turning to the drawings, FIG. 1 shows the ski board unit 10 of the present invention that allows one to ride a snow ski like a skateboard. Leaning from side to side turns the ski just like a skateboard. Leaning from side to side allows the ski to use its edges to turn like it was designed to do. FIG. 7 shows an exploded view.

The components of the ski board unit 10 include a skateboard platform 12, a base having an upper base part 14 and having a lower base part with a sliding portion 16 and a stationary portion 18, an adjustment screw 20 and a stabilizer 26. The adjustment screw extends across a gap 22 between the sliding portion 16 and the stationary portion 18 and into each of the sliding portion 16 and the stationary portion 18 to adjust the sliding movement of the sliding portion 16 towards and away from the stationary portion 18. The stabilizer 26 provides stability by preventing ejection of the lower part of the base from the front and read ski bindings. A tether 28 may be provided to extend from the skateboard platform 12 to loop around the ankle of a person's leg.

That is, the tether 28 attaches to the ski board 10 and keeps the ski board from sliding away from the user on a slope when the user falls or gets off the board. The tether 28 can be attached to the user's leg or held in the user's hand as the user operates the ski board unit 10. The length of the tether can be adjusted based on comfort and preference.

The turned up two ends of the skateboard top of the ski board platform allow for better grip while riding. A ruff sand paper grip covers the top of the skateboard platform 12.

The upper base part 14 retains the lower base part so as to retain the sliding portion 16 in a sliding manner and the stationary portion 18 in a stationary manner. The upper base part 14 has a grooved fit with the lower base part that keeps both the sliding portion 16 and the stationary portion 18 connected, allowing the sliding portion 16 to slide to the appropriate size of the ski binding. The sliding portion 16 slides back and forth as necessary to adjust to larger bindings.

Turning to FIGS. 3A through 3F, the sliding portion 16 is slid forward or backward as needed to adjust to larger or smaller ski bindings. One or more threaded adjustment screws 20 enable the user to adjust the size of the base that locks into the ski binding. By turning the adjustment screw 20 or screws in either a clockwise or counterclockwise direction as appropriate, the sliding portion 16 may be moved towards or away from the stationary portion 18, thereby increasing or decreasing the size of the gap 22.

To help with setting the correct position of the sliding portion 16, the sole 32 of the ski boot 30 may be placed beneath the lower base part as shown to serve as a guide to slide the sliding portion 26 to a relative position. In so doing, the sliding portion 16 of the lower part of the base is adjusted to slide from a position in which the distance of the lower part of the base from end to end is shorter than the length of the ski boot sole to a position in which the distance of the lower part of the base from end to end (inclusive of the gap 22) is equal to the length of the ski boot sole 32.

Figure 3A:
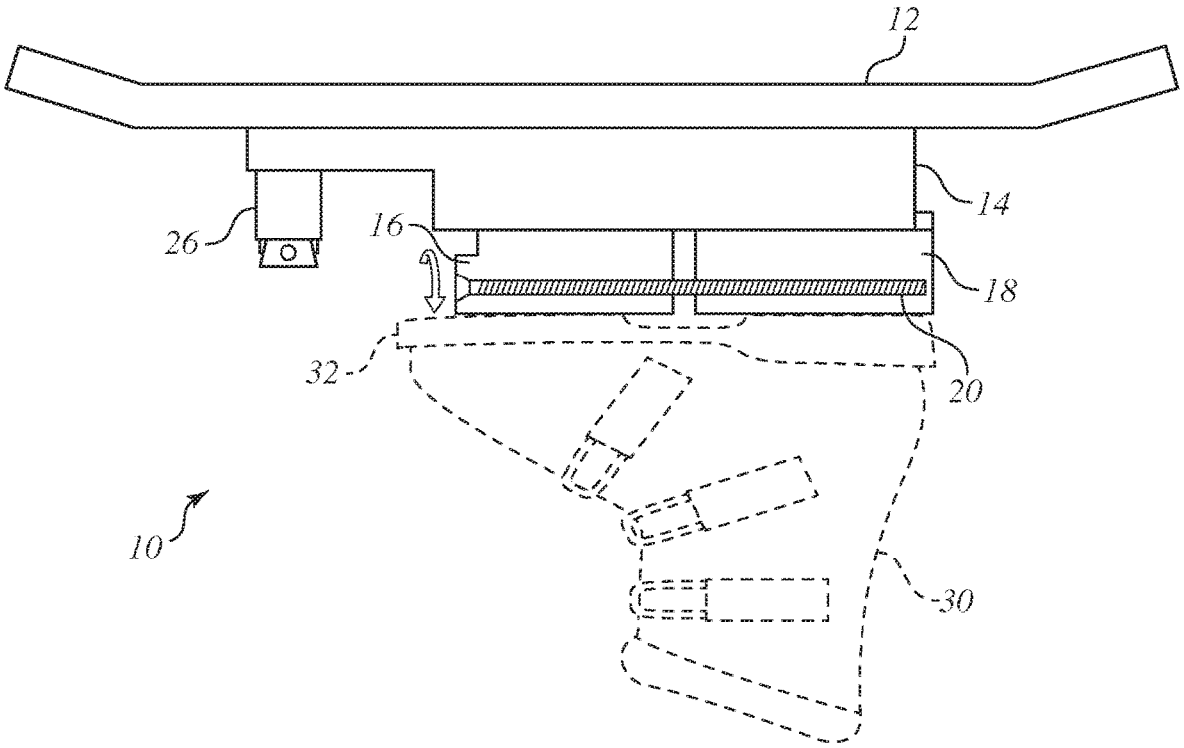
FIGS. 3A, 3B, 3C, 3D, 3E and 3F are progressive views for assembly of the ski board unit of FIG. 2 that shows the manner of adjusting a sliding portion of the lower part of the base into its proper position and then securing the base to bindings of a snow ski and then securing the stabilizer.
Figure 3B:
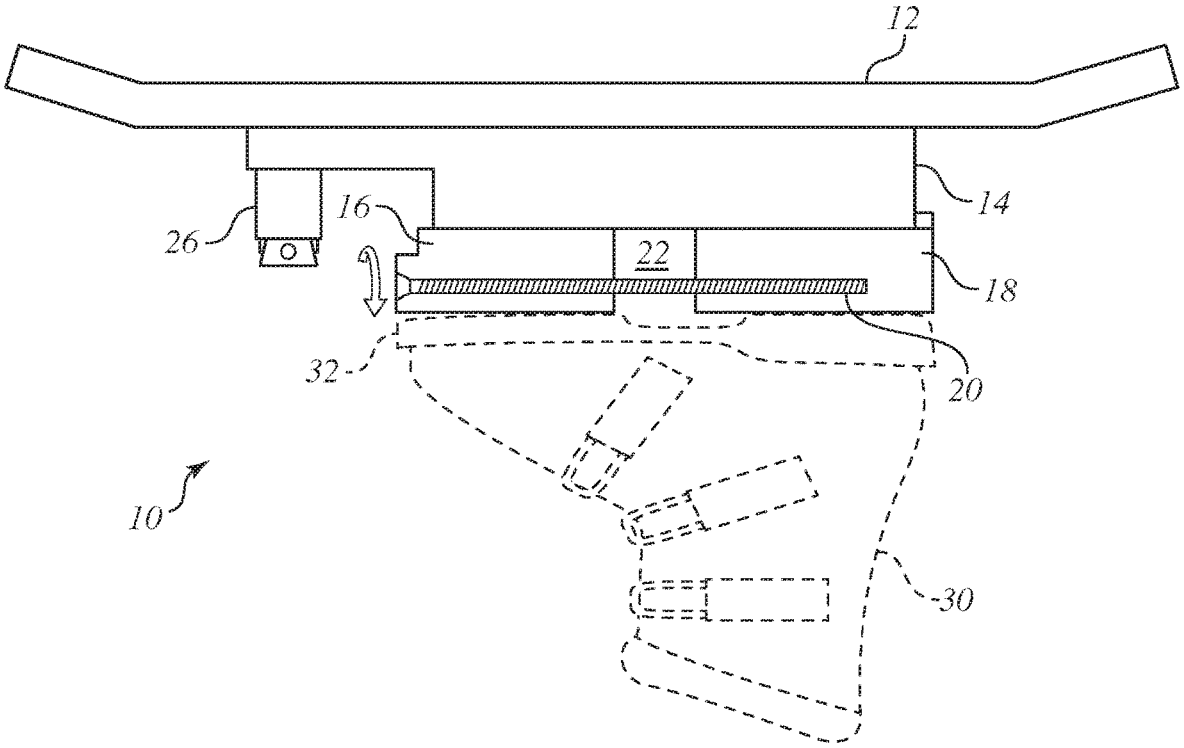
Figure 3C:
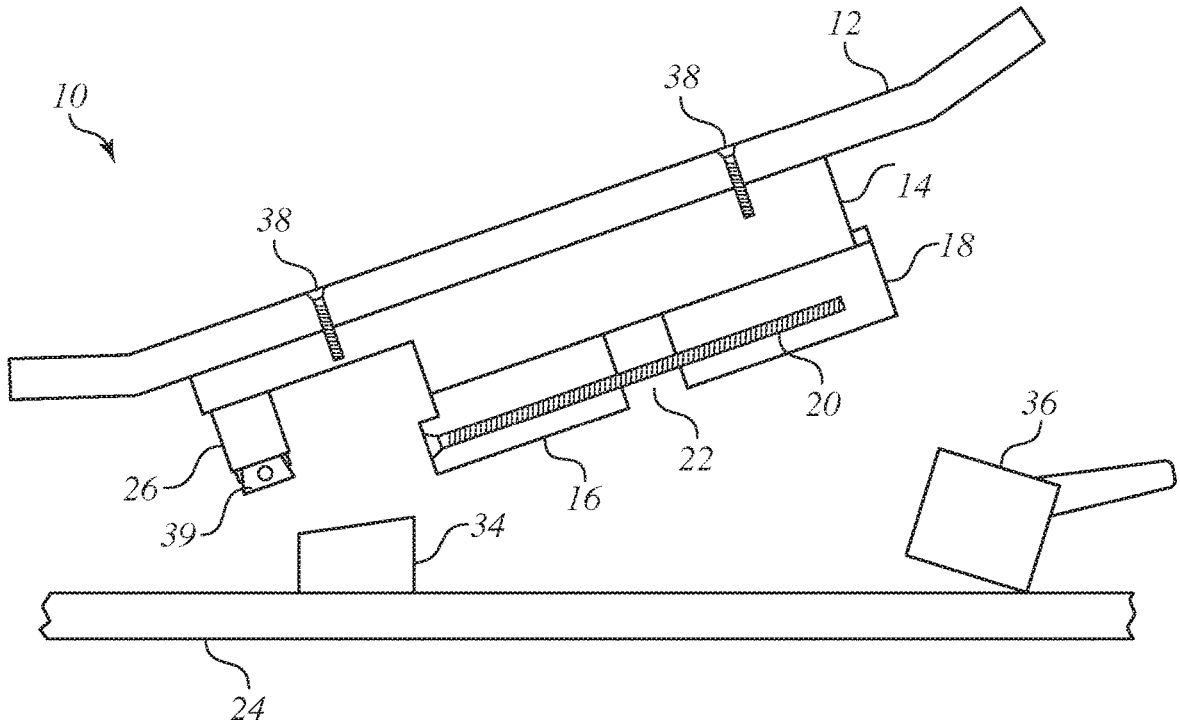
Figure 3D:
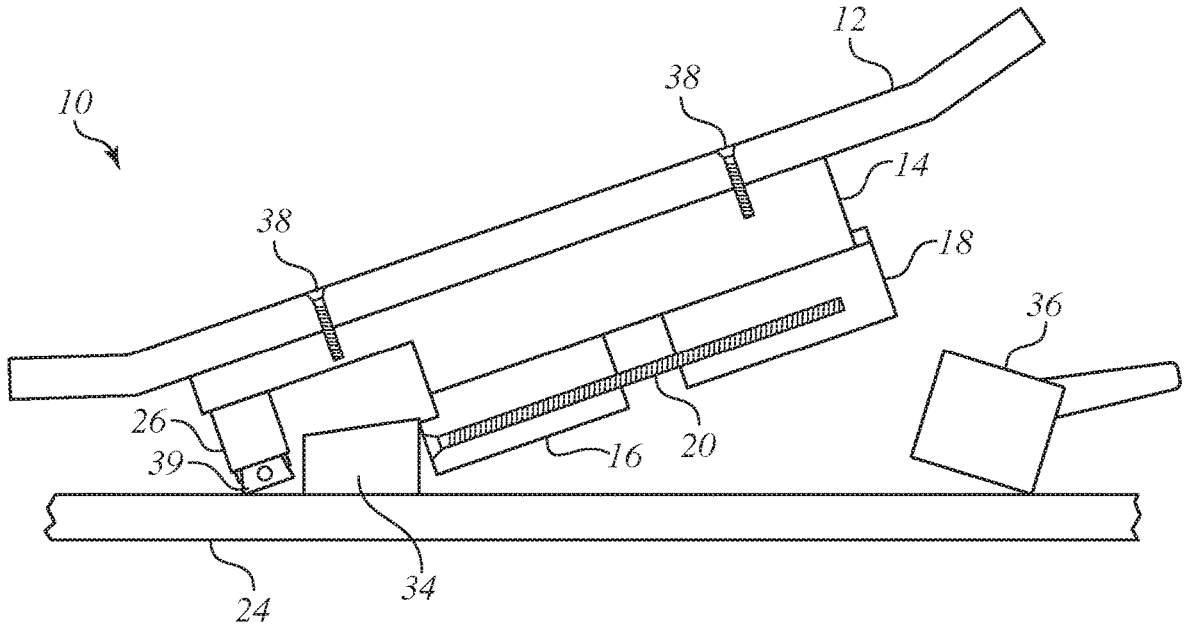
Figure 3E:
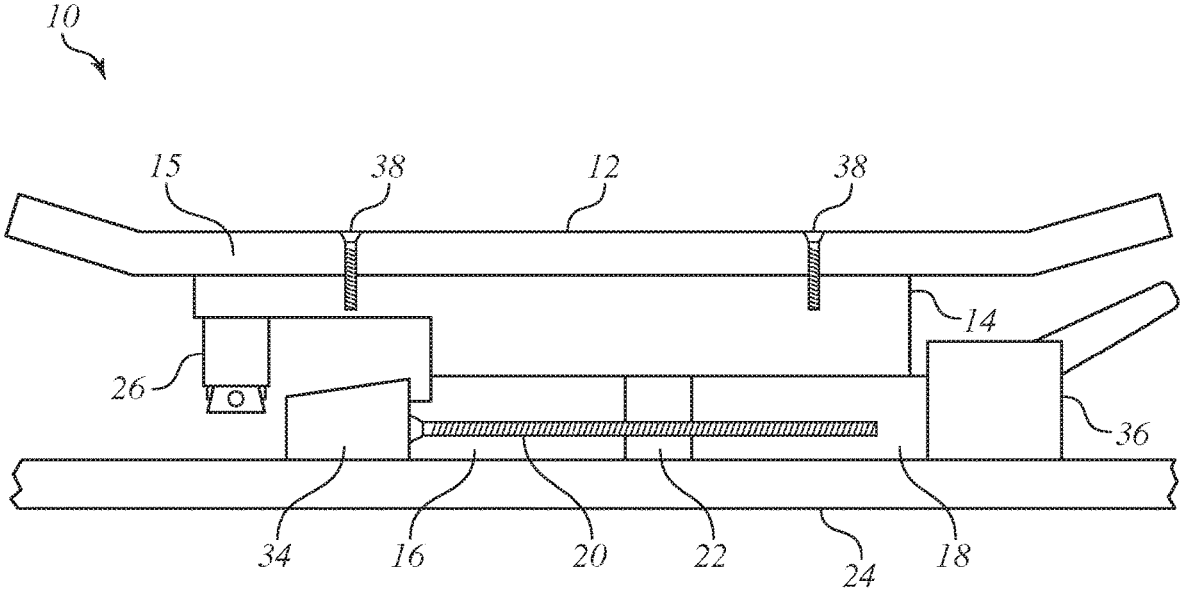

Once the end to end distance of the lower base part matches the end to end distance of the sole 32 of the snow ski boot 30, then, as shown in FIG. 3C-3D, the sliding portion 16 and the stationary portion 18 are ready to be inserted into conventional front and rear ski bindings 34, 36 of the snow ski 24 in the manner shown. The lower part of the base snaps into the conventional front and rear bindings just like a ski boot 30 (of FIG. 3A, FIG. 3B) would. The lower part of base of the ski board unit 10 adjusts to fit different size ski bindings. Thereafter, the stabilizer 26 of FIG. 3E is adjusted as to exert pressure between the underside of the overhang 15 of the upper part 14 of the base and the topside of the snow ski 24.

Figure 3F:
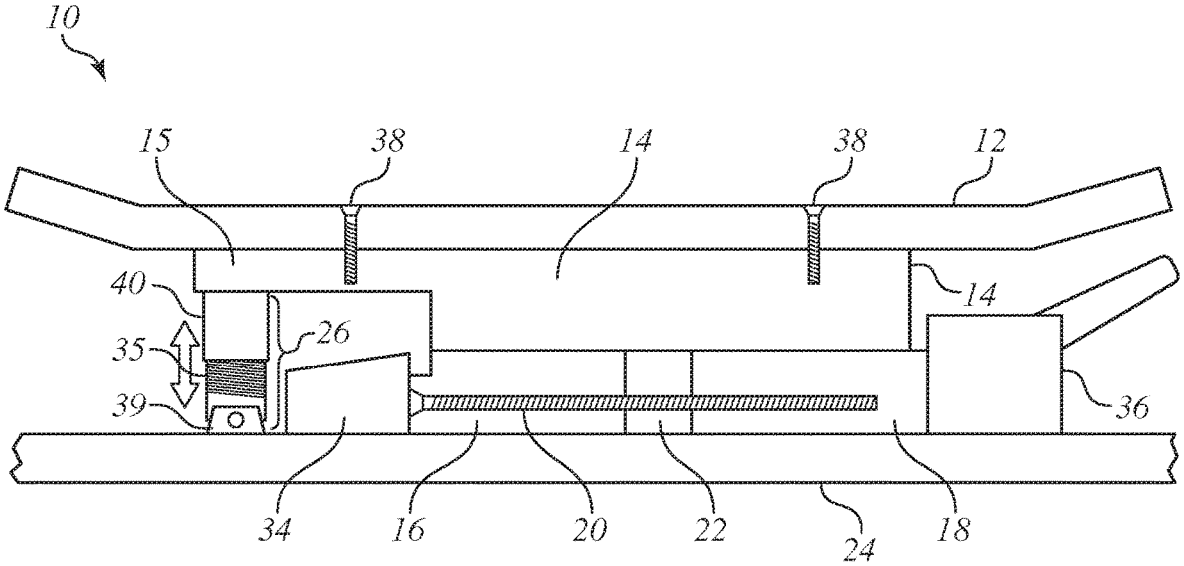

The adjustment of the stabilizer 26 is carried out as shown in FIG. 3F by unscrewing the inner cylinder 35 from the cylinder 40 until the hinged trapezoidal end piece 39 exerts pressure on the topside of the snow ski 24. Preferably, the base has a 4-inch height, which allows clearance of the ski binding and the skateboard platform 12.

Although not shown in FIGS. 1, 2, 3A and 3B, there are two sets of four threaded screws 38 of FIG. 7 that allow the user to secure the skateboard platform 12 to the base 14. As shown in FIG. 7 and understood from FIGS. 3G and 3H, the base has predrilled holes that align with the two sets of four threaded screws 38 of FIG. 7. If desired, additional pairs of such holes may be provided in the base 14 to enable the placement of the skateboard platform 12 to be adjusted forwards or backwards on the top of the base 14 to align the threaded screws 38 with the desired pairs of holes to make securement. Thus, the threaded screws 38 enable the user to adjust where the base that locks into the ski binding 34, 36 relative to the skateboard platform 12, which may enable the ski board unit 10 to be used with different size ski bindings. Although the embodiment of FIGS. 3C-3F has two pairs of threaded screws 38 (only two visible on side), preferably four pairs of threaded screws 38 as shown in FIG. 7 are used to provide stronger securement than can be provided by just two pairs of threaded screws 138.

The two sets of four screws generally correspond with the placement of two sets of four holes conventionally used to secure a support for a pair of wheels to the underside of a skateboard. The base 14 is provided with eight predrilled holes in its top surface to align with the two sets of four threaded adjustment screws 138. However additional pairs of predrilled holes may be provided in the base 14 to enable some adjustment as concerns the relative placement of the skateboard platform 12 on the base 14 by aligning the threaded adjustment screws 138 with desired pairs of holes in the base. The ski board in accordance with the invention may be assembled into an operative condition by following six steps (See FIGS. 3A-3F):

Step 1. Use a screwdriver to turn the adjustment screw to adjust the movable sliding portion 16 of the ski board base to match the size of the bottom or sole 32 of the ski boot 30 used for the ski one plans to use the ski board with. Turn the adjustment screw 20 counterclockwise to make the effective size of the base larger and clockwise to make smaller.

Step 2. Turn the adjustment screw 20 to adjust the movable sliding portion 16 of the ski board base to match the size of the bottom or sole 32 of the ski boot. Stop when there is a match.

Step 3. Line up the Ski board base like one would for one's ski boot 30 with the front tip of the ski board base going into the front part of the ski binding. Line up with nose/front of base first.

Step 4. Line up the Ski board base to the ski binding and just like one would with one's ski boots, putting the front of the ski boot into the front part of the ski binding and then push down on the back to snap the ski board base into the ski bindings.

Step 5. Use one's hand to twist the ski board stabilizer 26 to extend the stabilizer 26 to fit snug against the ski 24. The ski board stabilizer 26 is threaded 35, 40 and telescopic. As one twists the lower part of the stabilizer 26, it will extend down toward the ski 24.

Step 6. Once one has twisted the ski board stabilizer 26 to extend the stabilizer 26 to fit snug against the ski. It is now ready to start using the ski board on the snow.

Figure 3G:
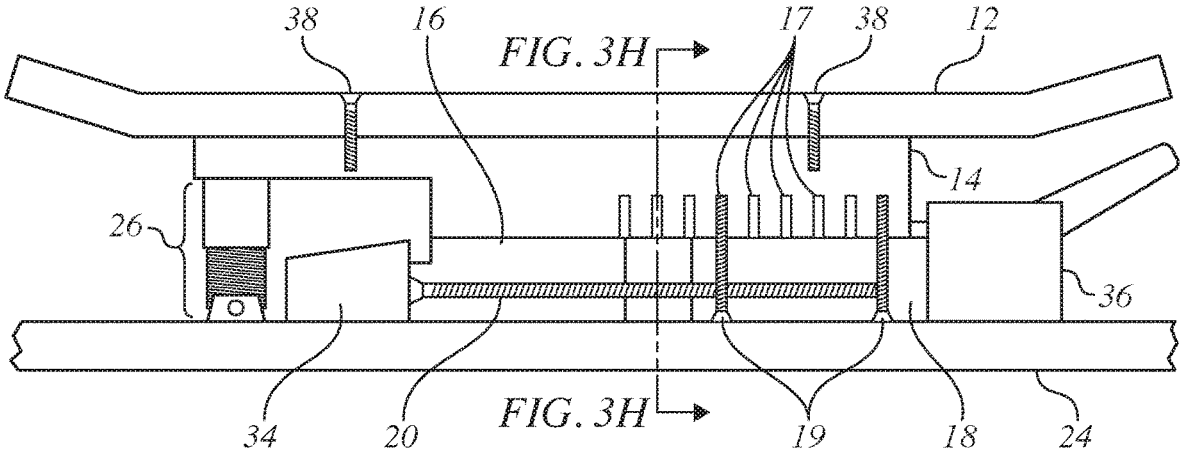
FIG. 3G is a longitudinal view of a further embodiment for assembly of the ski board unit of FIG. 2 with the rear lower part also being formed to slide.
Figure 3H:
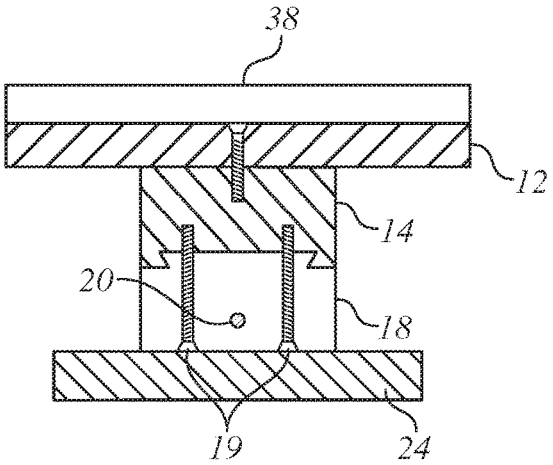
FIG. 3H is an end view of FIG. 3G.

Turning to FIGS. 3F and 3G, provision may be made to enable the stationary portion 18 to instead slide back and forth to fit larger bindings. As shown, the stationary portion 18 may be repositioned into any one of a plurality of different positions by choosing which group of two pairs of holes 17 in the upper part 14 of the base should align with four holes through the stationary portion 18 to secure the screws 19 accordingly. The sliding portion 16 may be slid and secured as in the other embodiments.

Figure 3I:
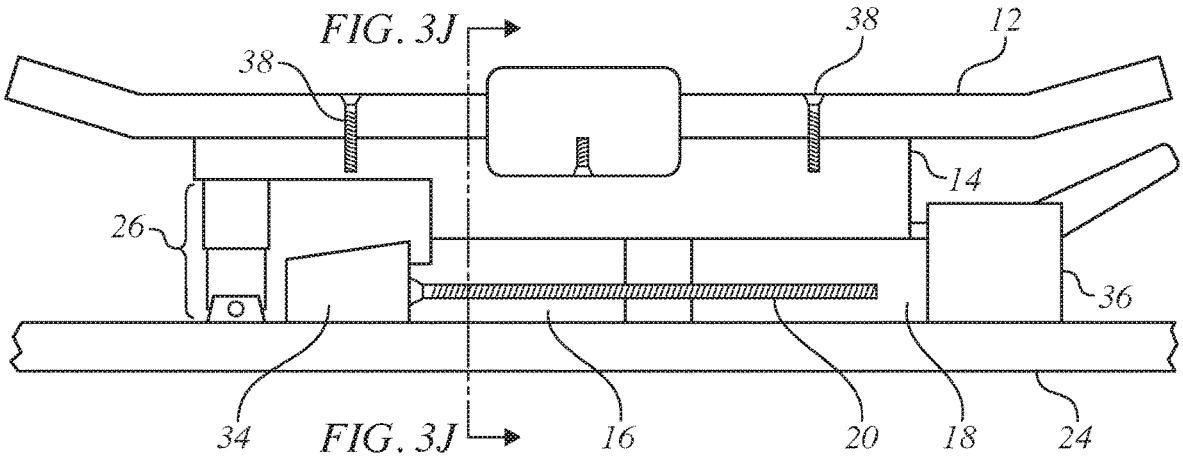
FIG. 3I is a longitudinal view of the ski board unit of FIG. 9 with a weight attached to one side to promote toppling over to that side.
Figure 3J:
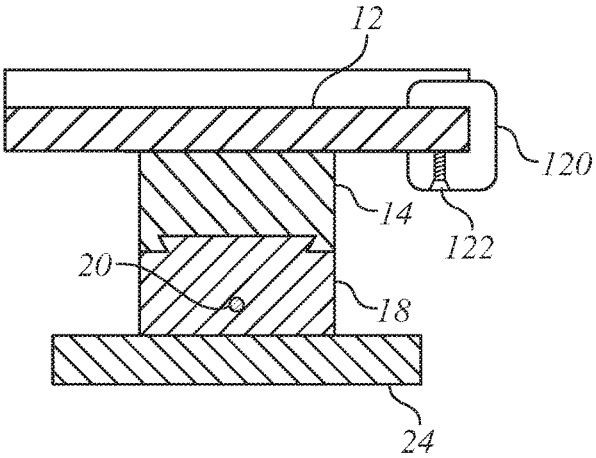
FIG. 3J is an end view of FIG. 8.

Turning to FIGS. 3I and 3J, a small weight 120 (e.g., one ounce) may be applied to one side of the base or clipped onto the platform one side and then tightened with a screw 122 to keep the small weight 120 in place. That way, should the user get off the ski board unit 10, the ski board unit 10 will likely tip over on the side of the weight, thereby preventing the ski board unit 10 from sliding away down a hill. Such a small weight applied to one side does not completely replace the functions of the brake since the ski board unit 10 will not remain upright for long since the weight is present, which means that the ski board unit 10 will not be held steady while the user is trying to step on the ski board unit 10. Further, the user is not able to gradually slow down the ski board unit 10 since there would be no brake of FIGS. 6A and 6B to apply. In its simplest form, the small weight could be a conventional one-ounce line clip weight whose bottom is tightened by turning the screw 122 to secure to one side of the platform.

Figure 4:
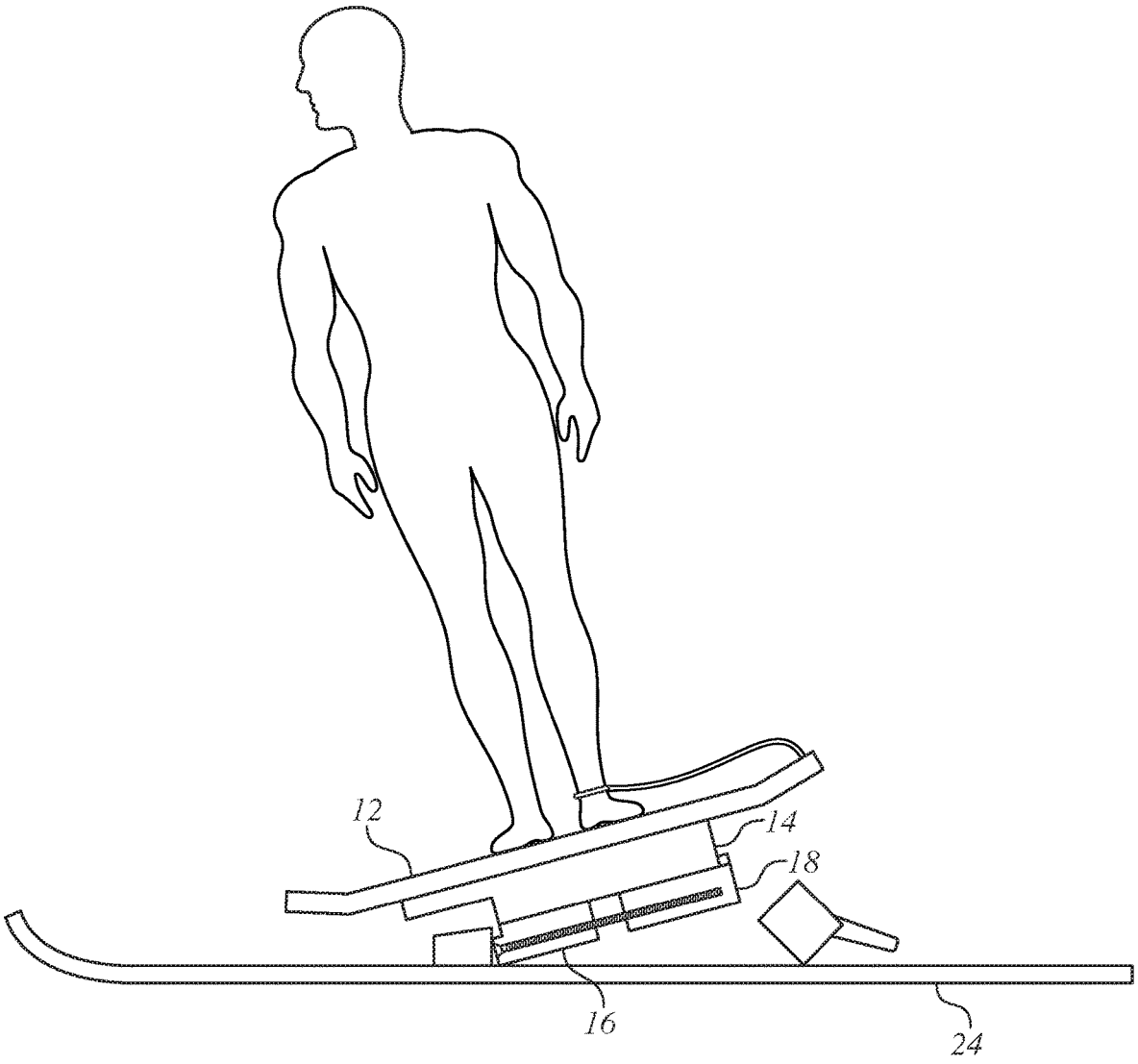
FIG. 4 is a side view of the assembled snow ski board unit of FIG. 2 but without the stabilizer so as to show how the ski bindings are triggered to eject the base.

The significance of the stabilizer 26 can be better appreciated by turning to FIG. 4 which illustrates what may happen in its absence or if not secured properly to exert pressure on the topside of the snow ski 24. That is, the person using the ski board unit 10 applies a weight force forward, which triggers the ski bindings to eject the sliding portion 15 and the stationary portion 18 of the lower part of the base. Indeed, the forward weight of the platform 12 itself may be enough to trigger the bindings to eject the base.

Figure 5A:
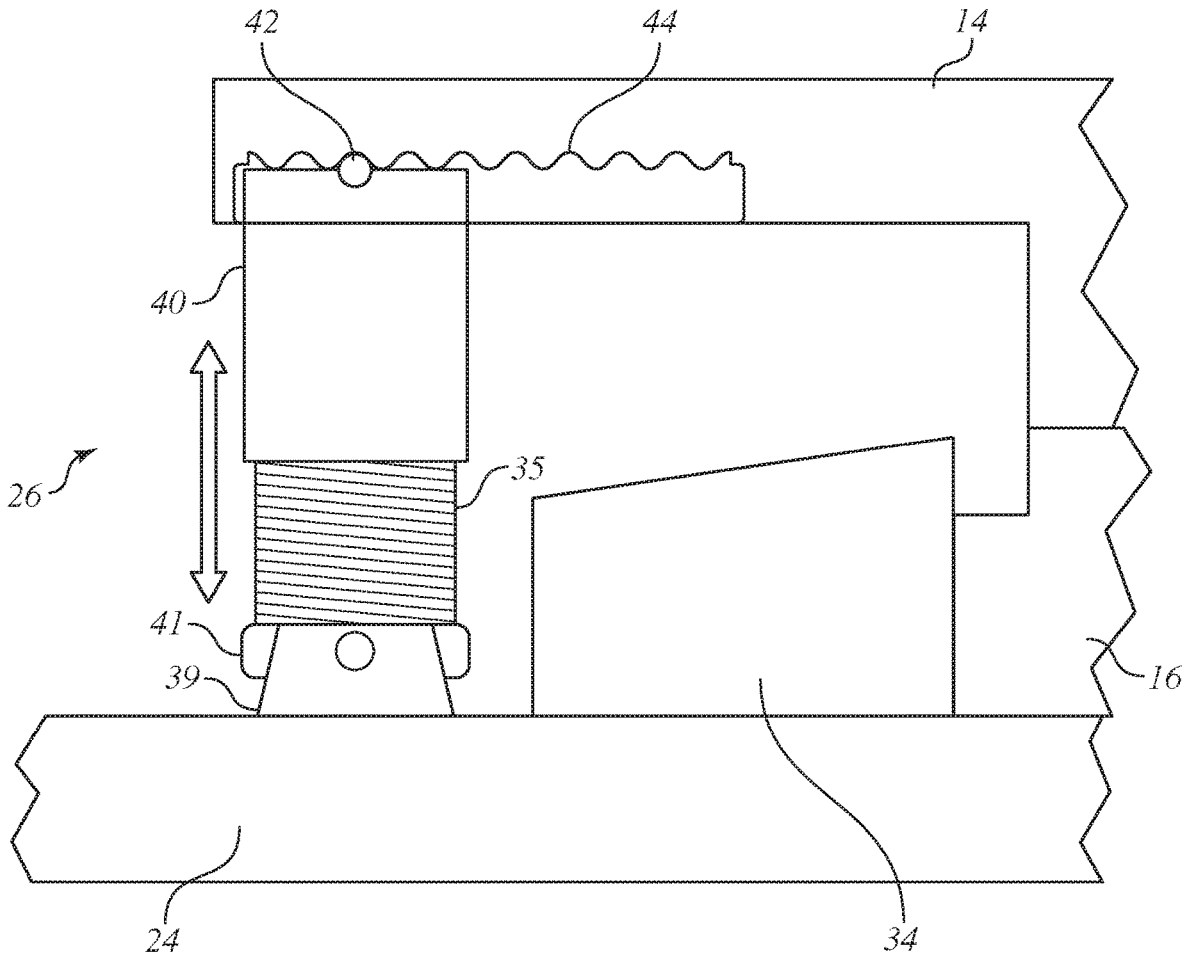
FIG. 5A is a side view of the stabilizer of the ski board unit in accordance with an embodiment of the invention.

Turning to FIG. 5A, the stabilizer 26 keeps the ski board 10 from ejecting when the rider applies their weight to the front of the ski board 10. The user does not have to adjust the ski binding tension to keep the ski board 10 from being ejected. It is safer not to adjust the ski binding tension, because it is set for the user's height, weight and ability. The user would want the ski binding to eject based on these factors when the user is skiing with the skis (without the board attached to a ski). The ski board 10 allows the user to use the existing skis at their current settings. It is easy to snap in and set and also easy to disengage the board from the ski.

A ski board stabilizer channel allows the stabilizer 26 to adjust toward and away from the binding. This allows the ski board unit 10 to adjust to different size bindings. The cylinder 35 goes inside cylinder 40. They are threaded and adjusted by twisting cylinder 35. Screw down to 'tighten' (i.e., shorten the overall length) and unscrew to 'loosen' (i.e., increase the overall length). There is a swivel part 41 attached to the bottom of the inside cylinder 40 to which is hinged a trapezoidal end piece 39.

By unscrewing the engaged threads of the cylinder 35 and the inside cylinder 40, the hinged trapezoidal end piece 39 rotates as need be to rotate so that the bottom of the hinged trapezoidal end piece 39 rests flat upon the incline of the snow ski 24. The stabilizer 26 provides front weight stability and keeps the bindings 34, 36 from ejecting upon the application of front weight pressure.

Upon screwing the engaging threads of the cylinder 40 and the inside cylinder 35, their end-to-end distance of them shortens and upon unscrewing the engaging threads of the cylinder 40 and inside cylinder, their end-to-end distance lengthens.

A channel pin 42 fits in selected one of grooves 44 of the grooved track to help secure the ski board stabilizer 26. The channel pin 42 presses into the selected one of the grooves 44 as the cylinder 40 and inside cylinder 35 are unscrewed sufficiently with end of the inside cylinder 35 pressing against a topside surface of the snow ski 24. A channel cap 47 is screwed in place into the overhang of the base 14 with screws 43 to keep the channel pin 42 fitted into position to the selected groove 44. By loosening the screws 43 and thereby the channel cap 47 from the overhang, the channel pin 42 may be relocated to a different groove 44 and thus the stabilizer 26 may be relocated accordingly.

Figure 5B:
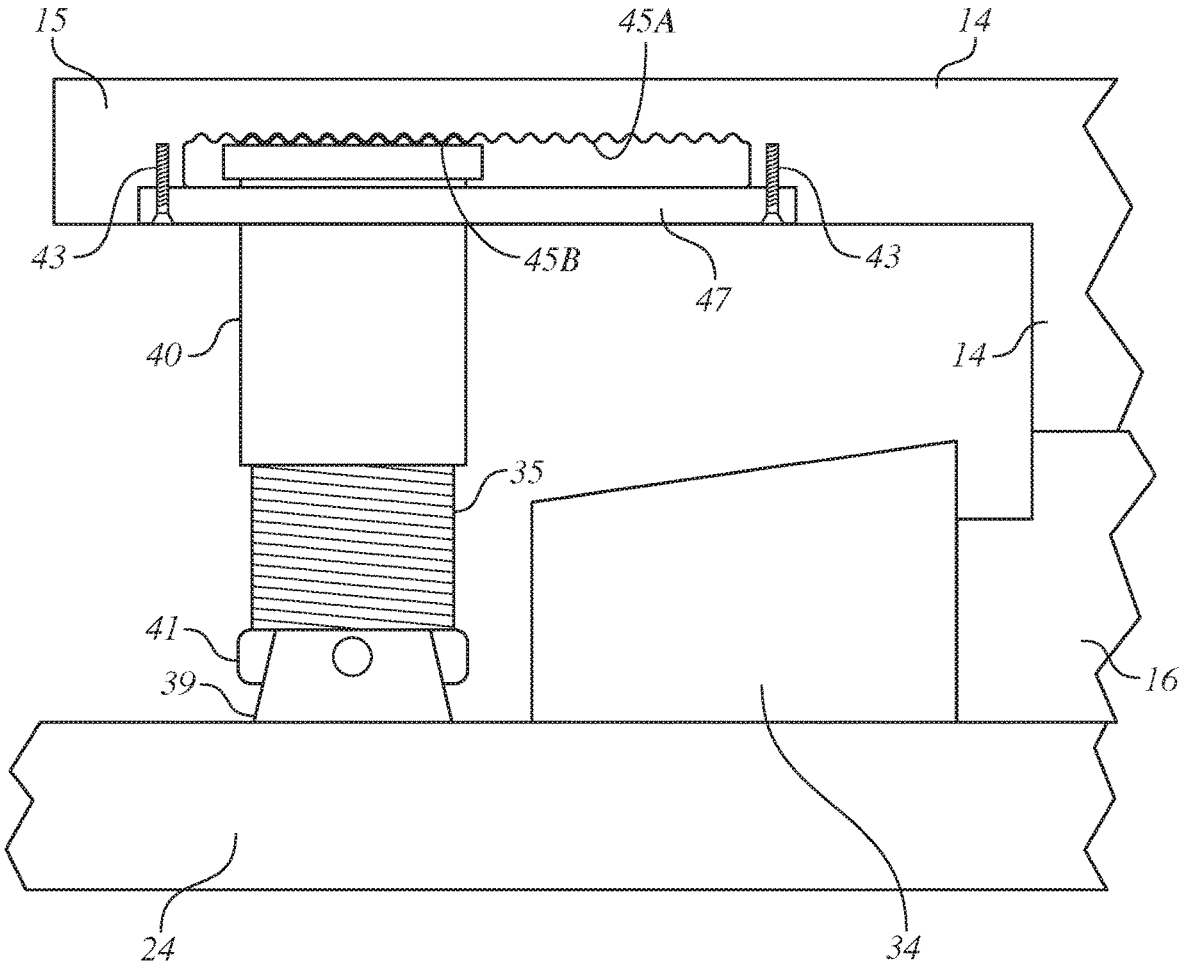
FIG. 5B is a side view of the stabilizer of the ski board unit in accordance with a further embodiment of the invention.

FIG. 5B is an alternative embodiment for the stabilizer to that of FIG. 5A in which the pin and grooved track of FIG. 5A are replaced by two rows of teeth 45A, 45B that engage and mesh with each other as the inside cylinder 35 is rotated counterclockwise relative to the cylinder 40 by a sufficient amount such that pressure is applied via the hinged trapezoidal end piece 39 to the topside of the snow ski 24. The row of teeth 45A is directed downwardly from the underside of the overhang 15 of the upper part 14 of the base.

When the inside cylinder 35 is rotated clockwise relative to the cylinder 40, pressure is released and the cylinder 40 and inside cylinder 35 may be displaced in a linear direction with the hinged trapezoidal piece 39 and one of the rows of teeth 45A closer to or further away from the sliding portion 16. The channel cap 47 has a center region that is open to accommodate the cylinder 40 being moved laterally to any position in which the two rows of teeth 45A, 45B may engage and mesh with each other. The channel cap 47 is secured to the underside of the overhang 15 of the upper part 14 of the base with screws 43.

Figure 5C:
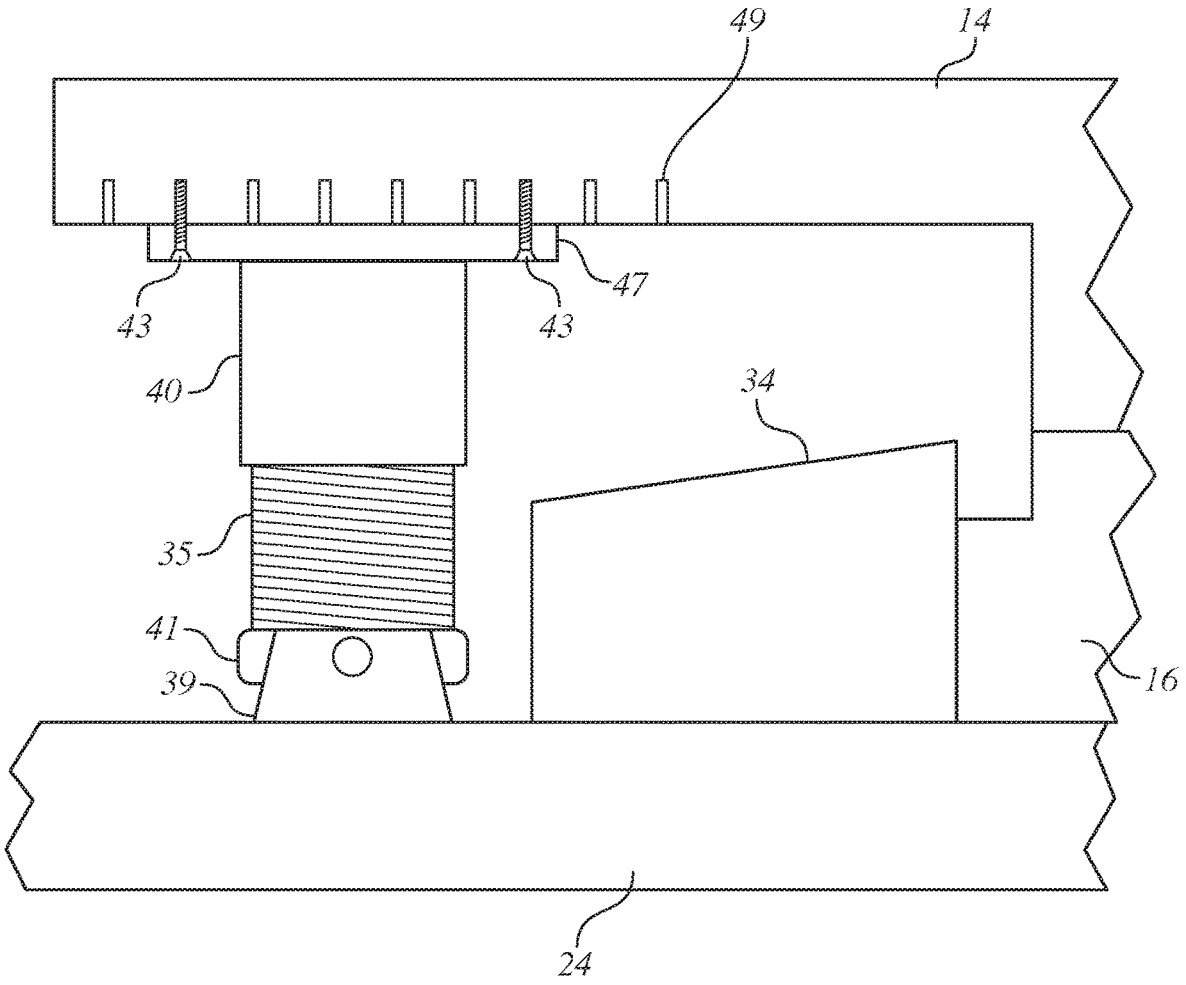
FIG. 5C is a side view of the stabilizer of the ski board unit in accordance with another embodiment of the invention.

FIG. 5C is a further embodiment of the stabilizer in that a series of predrilled threaded holes 49 are made in the underside of the overhang 15 of the upper part 14 of the base into which screws 43 are aligned and fastened to secure the channel cap 47 in place to allow the cylinder 40 to press against the underside of the overhang 15 as the hinged trapezoidal end piece 39 presses against the topside of the snow ski 39 that arises from unscrewing the inside cylinder 35 relative to the cylinder 40.

Figure 5D:
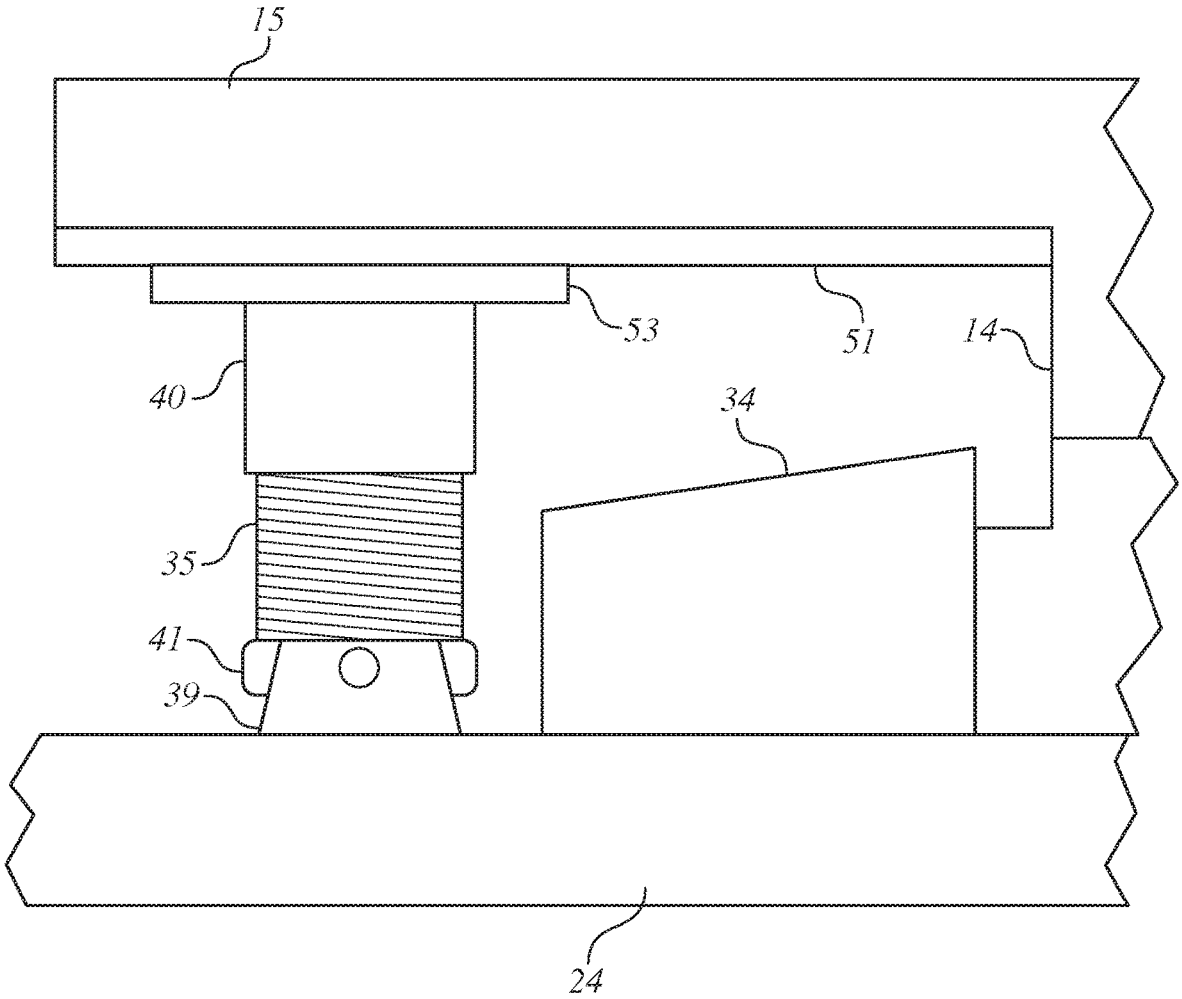
FIG. 5D is a side view of the stabilizer of the ski board unit in accordance with yet another embodiment of the invention.

FIG. 5D is yet another embodiment of the stabilizer in which a magnetic strip 51 is provided on the underside of the overhang of the base and a further magnet 53 is provided atop the cylinder 40 of the stabilizer to magnetically attract with the magnetic strip 51. The magnetic force should be strong enough to support the weight of the stabilizer dangling from the overhang 15 of the upper part 14 of the base as the internal cylinder 35 is being rotated until the hinged trapezoidal end piece 39 exerts pressure upon the topside of the snow ski 24.

FIG. 4 shows that without the stabilizer 26, the application of forward weight would tend to trigger the bindings to eject the base from the bindings.

Figure 6A:
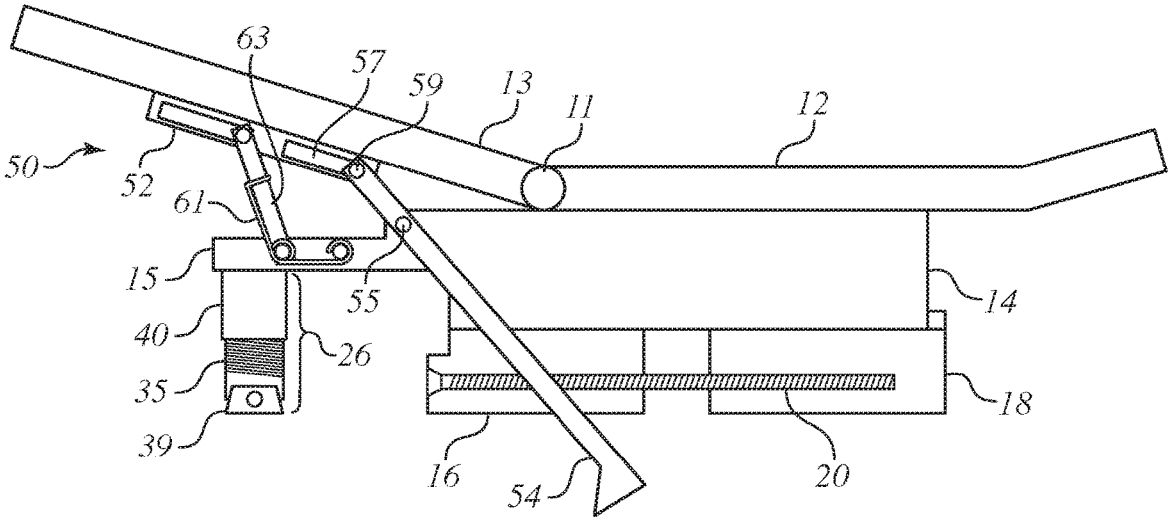
FIG. 6A is a side view of a ski board unit brake in a deployed condition in accordance with the invention.

Turning to FIG. 6A, a brake mechanism 50 holds the ski board unit 10 in place until the user is fully on the ski board unit 10 with both feet. The platform 12 has a forward portion 13 that is hinged to the rest of the platform at a hinge 11. The base 14, which has the overhang 15, also has a raised portion adjacent the overhang 15 so as to enable the brake seat 52 to fit in a recess alongside the stepped end of the raised portion and be above the overhang 15.

Figure 6B:
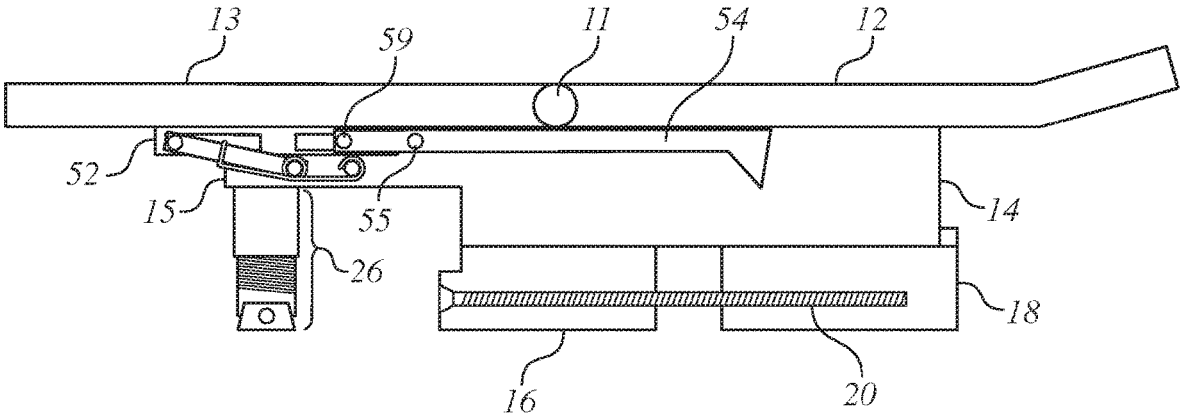
FIG. 6B is a side view of the ski board unit brake of FIG. 6A in a non-deployed condition in accordance with the invention.

When the user applies weight to the front of the ski board and depresses the brake seat 52, the arm 54 pivots about pivot 55 so that the brake seat 52 disengages from its brake position to enter into a non-braking position of FIG. 6B. As the pivoting commences, a rod 59 at the end of the arm 54 slides within an open track 57 in the brake seat 52 in response to the pivoting force exerted about the pivot 55 by depressing the brake seat 52.

When the user removes their feet from the forward portion 13 of the platform 12, the forward portion of the arm 54 lowers because of pivoting movement about the pivot 55 under spring tension from spring 61 in or on lever arm 63 so that the brake seat 52 returns to the activated brake position of FIG. 6A.

Figure 6C:
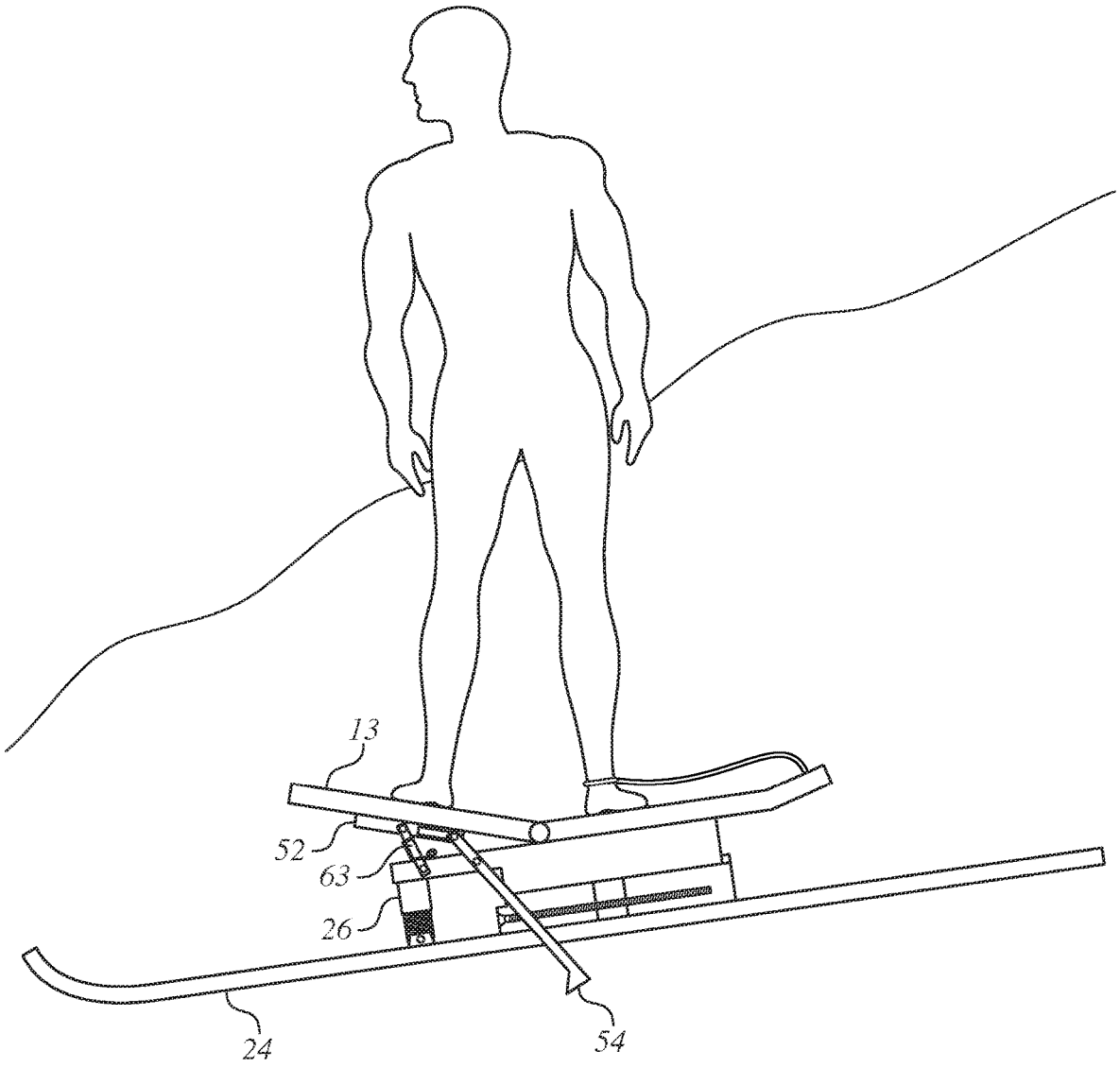
FIG. 6C-6E are progressive views of the ski board unit brake of FIG. 7 to show activation, deactivation and reactivation of the brake.
Figure 6D:
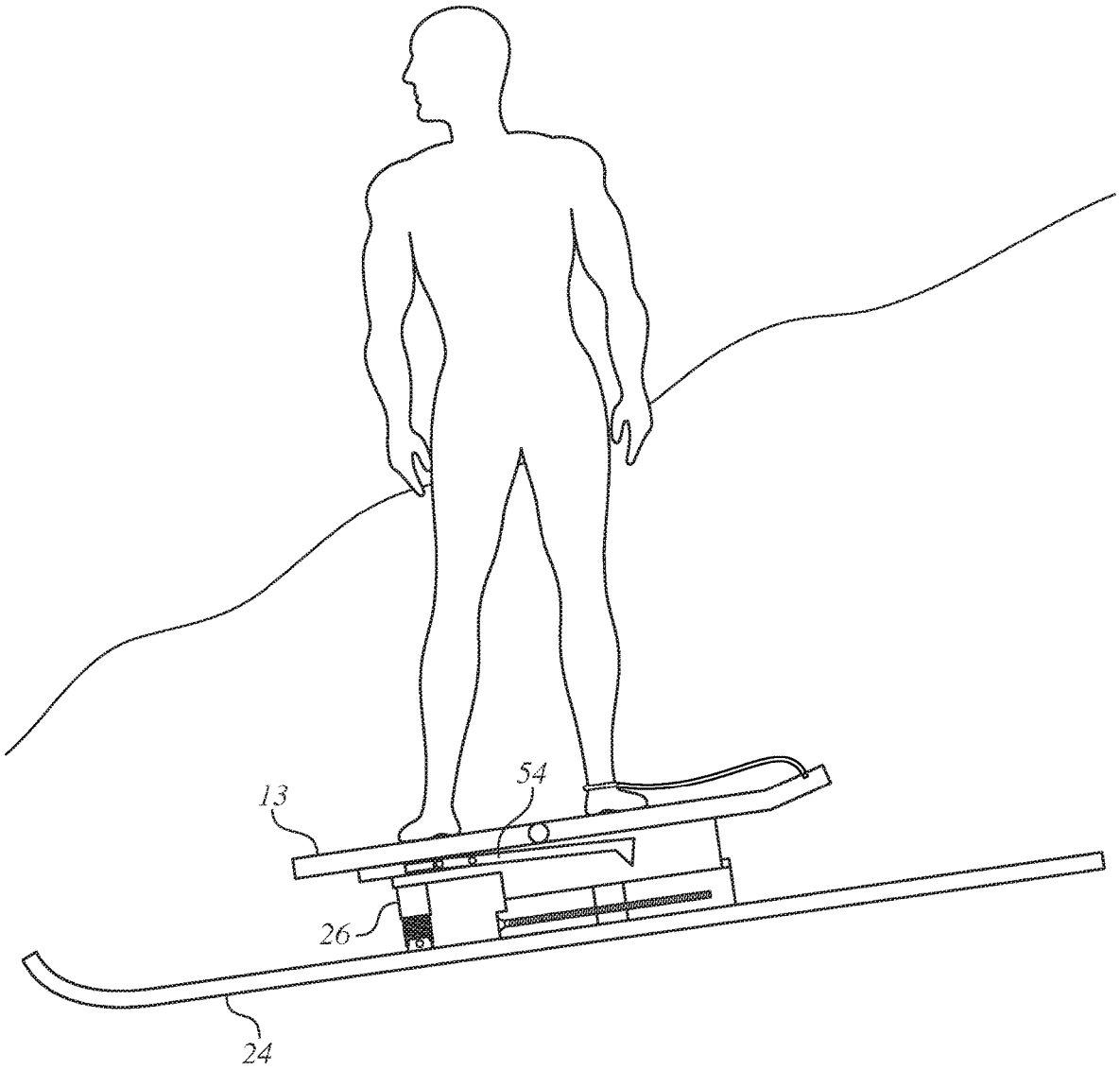
Figure 6E:
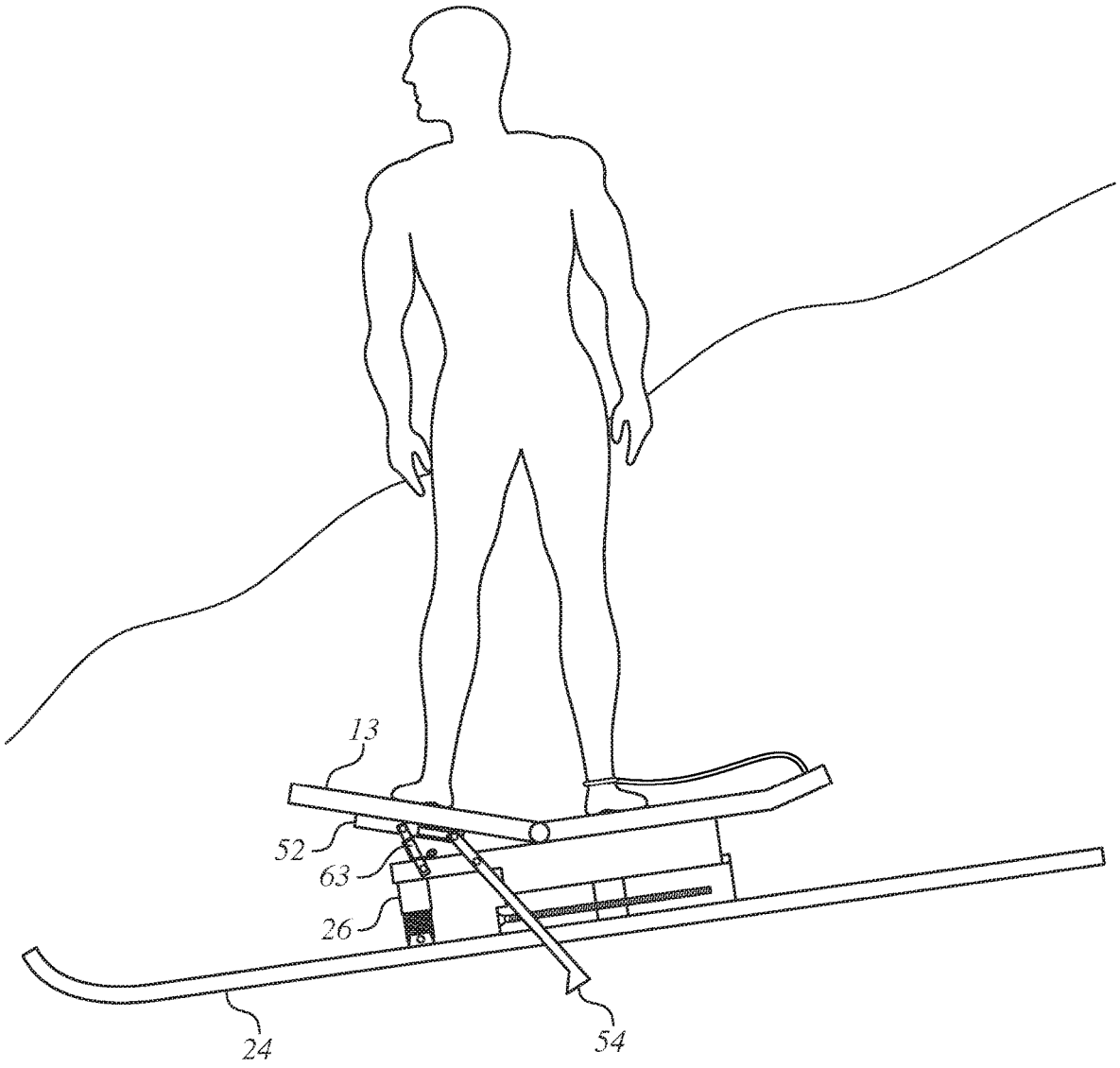

When deployed, the arm 54 pivots to stop the ski board unit 10 from sliding forward. When weight is put on the front of the ski board unit 10, the brake mechanism is depressed and the arm retracts/disengages. The tension spring 61 lifts up the brake seat 52 when the user's weight has been lifted and deploys the arm 54 to stop the ski board 10 from sliding forward. FIGS. 6C-6E show how to activate, deactivate and reactivate the brake mechanism 50 merely by pressing down with one's foot onto the forward portion 13 of the platform to deactivate the brake and thereafter removing one's foot from pressing down to allow the spring tension to restore the brake to the activated position.

Figure 6F:
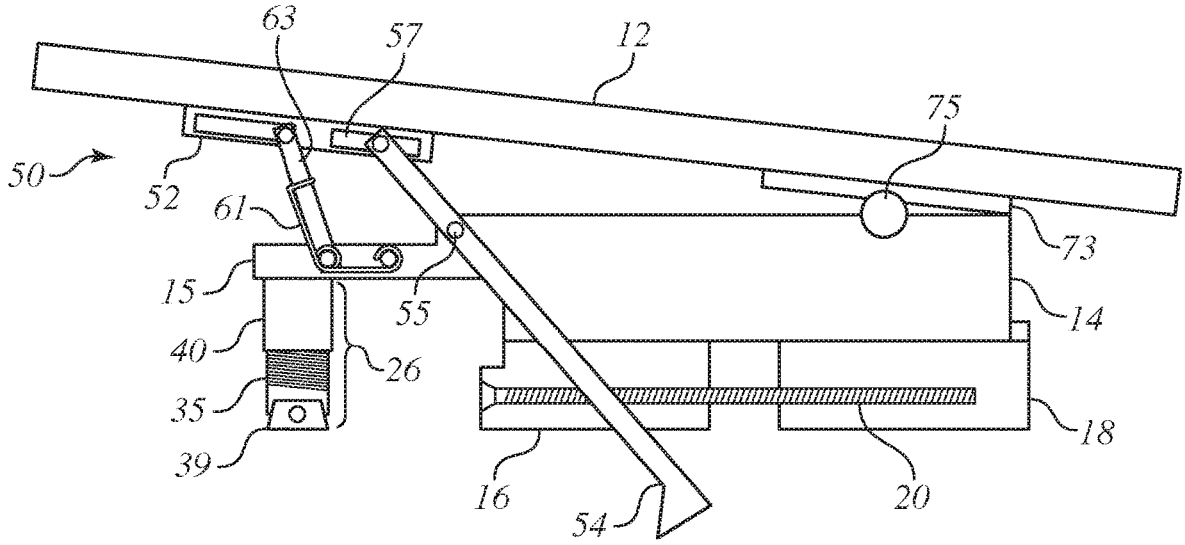
FIGS. 6F and 6G are side views that correspond to that of FIGS. 6A and 6B, but for a different embodiment.
Figure 6G:
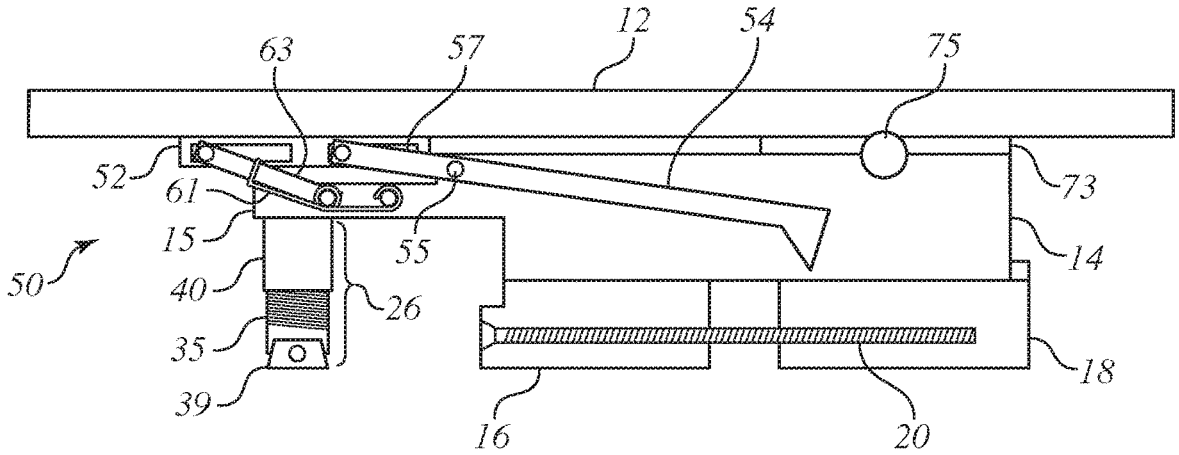

FIGS. 6F and 6G correspond to the views of FIGS. 6A and 6B, but for a different embodiment in that the hinged front portion 13 of FIGS. 6A and 6B is omitted so that the platform 12 is a single piece and not hinged into two portions. In addition, a rear support 73 is provided underneath a rear portion of the platform in the vicinity of the platform 12 where a hole or holes to secure a conventional skateboard wheel or wheels is/are provided. The rear support 73 is pivoted to the topside of the base 12 with a pivot 75. The underside of the platform 12 is secured to the rear support 73 by one or more screws. The underside of the platform 12 is also secured to the brake seat 52.

An advantage of the brake of FIGS. 6A and 6B over that of the brake of FIGS. 6F and 6G is the ability for the user to apply the brake gradually as the ski board unit 10 is in motion to slow the ski board unit. On the other hand, the brake of FIGS. 6F and 6G has an advantage over that of the brake of FIGS. 6A and 6B in that any conventional skateboard platform may be used without any need to modify the skateboard itself. Such is not the case for the brake of FIGS. 6A and 6B because the skateboard may need to be split into two parts that are then hinge to each other.

However, the brake of FIGS. 6A and 6B and the brake of FIGS. 6F and 6G offer the ability of keeping the ski board unit 10 steady and secure when left on a hill incline to enable the user to step on the platform for use of the ski board unit.

Also, both prevent the ski board unit from sliding down a hill on its own since the lever arms are spring loaded to push against the ground.

All components of the base of the ski board unit may be fastened to each other and to the underside of the platform by conventional fastening techniques, such as with fasteners (screws in screw-threaded holes). Pivots and hinges of the brake or below the rear support may be secured to the base in any conventional manner that permits pivoting about the pivot and rotation about the hinges.

While the foregoing description and drawings represent the preferred embodiments of the present invention, it will be understood that various changes and modifications may be made without departing from the scope of the present invention.

What is claimed is:

1. An apparatus for locomotion, comprising:

a platform;

a base to which the platform is connected, the base being configured to be held in a secure manner by bindings of a ski; and a brake mechanism attached to at least one of the platform and the base that is movable between a non-deployed brake position that allows locomotion of the platform and the base and a deployed brake position that stops locomotion of the platform and the base, wherein the brake mechanism has a brake seat, a lever arm and a spring arm, the lever arm being pivotally connected to the base, the brake seat having two slots, the lever arm having a lever arm end with a rod that slides back and forth in one of the two slots, the spring arm having a spring arm end with a further rod that slides back and forth in a remaining one of the two slots, the spring arm including a tension spring with a spring bias that tends to elevate the brake seat away from the base and impart a force on the lever arm that pivots the lever arm into the deployed brake position, the brake seat moving into a recess of the base in response to exertion of a manual force from above to depress the brake seat to cause the lever arm to pivot into the non-deployed brake position.

2. The apparatus of claim 1, wherein the platform has an underside secured to the brake seat; further comprising:

a rear support attached to the underside of the platform and spaced from where the brake seat is secured to the underside, the rear support being pivotally connected to the base.

3. The apparatus of claim 1, wherein the platform has a front portion and a rear portion hinged to each other, the front portion having an underside to which is secured the brake seat, the rear portion being secured to the base.

4. An apparatus for locomotion, comprising:

a platform;

a base to which the platform is connected, the base being configured to be held in a secure manner by bindings of a ski;

a brake mechanism attached to at least one of the platform and the base that is movable between a non-deployed brake position that allows locomotion of the platform and the base and a deployed brake position that stops locomotion of the platform and the base; and a ski having the bindings, which are movable between a lock position and a release position, the base being between the ski and the platform, the base having a plurality of base components with at least one of the base components being movable back and forth relative to a remainder of the base components between a non-engaged position and an engaged position with the bindings being in the release position, the bindings being movable into the lock position with the at least one of the plurality of based components being in the engaged position; and a stabilizer having a plurality of stabilizer components with at least one of the stabilizer components being movable back and forth between a non-deployed stabilizer position at which the stabilizer is clear of the ski and a deployed stabilizer position at which the stabilizer engages a topside of the ski.

5. The apparatus of claim 4, wherein the ski is a snow ski and the platform is a skateboard platform.

6. The apparatus of claim 4, wherein, with the stabilizer in the non-deployed stabilizer position, the stabilizer is movable between a position that is closer to the at least one of the base components and a further position that is further away from the at least one of the base components.

7. The apparatus of claim 4, wherein the plurality of base components includes two sliding members that are configured to slide toward and away from each other.

8. An apparatus for locomotion, comprising:

a platform;

a base to which the platform is connected, the base being configured to be held in a secure manner by bindings of a ski;

a brake mechanism attached to at least one of the platform and the base that is movable between a non-deployed brake position that allows locomotion of the platform and the base and a deployed brake position that stops locomotion of the platform and the base; and a weight secured to one side of the platform that causes the platform to topple from the one side in an absence of a counterbalancing force.

9. A method for locomotion, comprising:

connecting a platform and a base together, the base being configured to be held in a secure manner by bindings of a ski; and attaching a brake mechanism to at least one of the platform and the base, the brake mechanism moving between a non-deployed brake position that allows locomotion of the platform and the base and a deployed brake position that stops locomotion of the platform and the base;

pivotally connecting a lever arm of the brake mechanism to the base, the brake mechanism also having a brake seat and a spring arm, the brake seat having two slots, the lever arm having a lever arm end with a rod that slides back and forth in one of the two slots, the spring arm having a spring arm end with a further rod that slides back and forth in a remaining one of the two slots, the spring arm including a tension spring with a spring bias that tends to elevate the brake seat away from the base and impart a force on the lever arm that pivots the lever arm into a deployed position, the brake seat moving into a recess of the base in response to exertion of a manual force from above to depress the brake seat to cause the lever arm to pivot into a non-deployed position.

10. The method of claim 9, further comprising:

securing an underside of the platform to the brake seat; and attaching a rear support to the underside of the platform at a location that is spaced from where the brake seat is secured to the underside and pivotally connecting the rear support to the base.

11. The method of claim 9, further comprising:

hinging a front portion of the platform and a rear portion of the platform to each other; securing the brake seat to an underside of the front portion of the platform; and securing the rear portion of the platform to the base.

12. The method of claim 9, further comprising:

moving at least one of a plurality of base components of the base back and forth relative to a remainder of the plurality of base components between a non-engaged position and an engaged position; and moving bindings of a ski between a release position and a lock position so that with the binding in the release position, the at least one of the plurality of base components is movable between the non-engaged position and the engaged position, wherein the bindings are movable into the lock position with the at least one of the plurality of base components being in the engaged position.

13. The method of claim 12, further comprising:

moving stabilizer components of a stabilizer back and forth between a non-deployed position at which the stabilizer is clear of the ski and a deployed position at which the stabilizer engages a topside of the ski.

14. The method of claim 12, wherein, with the stabilizer in the non-deployed position, moving the stabilizer between a position that is closer to the at least one of the base components and a further position that is further away from the at least one of the base components.

15. The method of claim 12, wherein the at least one base component includes two sliding members that are configured slide toward and away from each other.

16. The method of claim 9, further comprising:

securing a weight to one side of the platform that causes the platform to topple from the one side in an absence of a counterbalancing force.

17. The method of claim 9, wherein the ski is a snow ski and the platform is a skateboard platform.

* * * * *